US009803432B2

(12) United States Patent
Wood et al.

(10) Patent No.: US 9,803,432 B2
(45) Date of Patent: Oct. 31, 2017

(54) ROLLER DEVICE

(71) Applicant: National Oilwell Varco UK Limited, Manchester (GB)

(72) Inventors: Carl Wood, Alford Aberdeenshire (GB); Harry Richard Stanley O'Brien, Elrick (GB)

(73) Assignee: NATIONAL OILWELL VARCO UK LIMITED, Manchester (GB)

( * ) Notice: Subject to any disclaimer, the term of this patent is extended or adjusted under 35 U.S.C. 154(b) by 298 days.

(21) Appl. No.: 14/442,973

(22) PCT Filed: Nov. 14, 2013

(86) PCT No.: PCT/GB2013/053007
§ 371 (c)(1),
(2) Date: Aug. 27, 2015

(87) PCT Pub. No.: WO2014/076481
PCT Pub. Date: May 22, 2014

(65) Prior Publication Data

US 2015/0361731 A1 Dec. 17, 2015

(30) Foreign Application Priority Data

Nov. 16, 2012 (GB) ..... 1220665.2
Nov. 19, 2012 (GB) ..... 1220774.2

(51) Int. Cl.
*E21B 17/10* (2006.01)

(52) U.S. Cl.
CPC ..... *E21B 17/1057* (2013.01); *E21B 17/1071* (2013.01)

(58) Field of Classification Search
CPC ..... E21B 17/1057; E21B 17/1071
See application file for complete search history.

(56) References Cited

U.S. PATENT DOCUMENTS 3,145,099 A * 8/1964 Parana ..... C22C 19/00 420/456
4,958,692 A * 9/1990 Anderson ..... E21B 4/003 175/323
5,522,467 A 6/1996 Stevens et al.
5,715,898 A 2/1998 Anderson
6,666,267 B1 * 12/2003 Charlton ..... E21B 17/1078 166/241.1
7,434,627 B2 10/2008 Turley et al.
(Continued)

OTHER PUBLICATIONS

ISA, International Search Report, Sep. 30, 2014, 3 pages.
ISA, Written Opinion, Sep. 30, 2014, 6 pages.

*Primary Examiner* — Cathleen R Hutchins
(74) *Attorney, Agent, or Firm* — Drinker Biddle & Reath LLP

(57) ABSTRACT

A roller device for incorporation into a wireline tool string for use in an oil or gas well has a body with rollers comprising captive bearings arranged on the outer surface of the body to rotate around more than one axis relative to the body, and wherein the rollers are arranged in at least one or more helix around the body. Each helix completes at least one full circumferential turn around the body. The rollers circumferentially overlap one another on the body, so that when the body engages the inner wall of the wellbore, the entire circumference of the body is supported by at least one roller.

34 Claims, 8 Drawing Sheets

(56) References Cited

U.S. PATENT DOCUMENTS

| | | | | |
|---|---|---|---|---|
| 2002/0020526 | A1* | 2/2002 | Male | E21B 17/1057 166/241.6 |
| 2003/0159834 | A1 | 8/2003 | Kirk et al. | |
| 2006/0070733 | A1 | 4/2006 | Al-Zahrani | |
| 2008/0164018 | A1 | 7/2008 | Hall | |
| 2008/0181717 | A1* | 7/2008 | Olivier et al. | G01V 1/201 403/24 |
| 2008/0264639 | A1 | 10/2008 | Parrott et al. | |

* cited by examiner

ROLLER DEVICE

FIELD OF THE INVENTION

The present invention relates to a roller device. A particular example of the invention relates to a roller device for use in strings of tools used in oil and gas wellbores. A particular example relates to a roller device used in wireline tool strings deployed in such bores.

BACKGROUND

Wireline, electric line and slickline are commonly used in oil and gas wells to deliver strings of tools to a desired location in a wellbore. The wireline string is suspended from a wire or an electrical cable or the like, and is lowered into the well from a winch located at the surface. The wire is spooled out until the tool string is at the desired depth in the wellbore, and the tools are then deployed. Wireline tool strings have many purposes, and in the context of the present invention, many different wireline tools can be used without departing from the scope of the invention. Likewise the nature of the cable (plain wire or electrical cable or some other conduit) can be varied in the context of the present invention without departing from its scope.

Wireline tool strings commonly include a roller device, typically having rollers such as wheels protruding from a body, so as to engage the inner surface of the casing of the wellbore in which the tool string is deployed, and reduce the friction between the casing and the tool string as the tool string moves into and out of the well. This increases the reach of the tool string, particularly in deviated wellbores. Existing designs of wireline roller tool typically favour large diameter wheels, for stability and so that the roller device rides easily over lips at the junctions between adjacent stands of pipe.

US2008/0264639, US2008/0164018, US2006/0070733 and U.S. Pat. No. 7,434,627 are useful for understanding the invention.

SUMMARY OF THE INVENTION

According to the present invention there is provided a roller device for incorporation into a wireline tool string for use in an oil or gas well, the roller device having a body with at least one connector suitable for connection of the roller device body into the string, and having a plurality of rollers on the outer surface of the body, wherein the rollers comprise captive bearings arranged to rotate around more than one axis relative to the body, and wherein the rollers are helically arranged on the body.

The invention also provides a method of deploying a wireline tool string in a wellbore of an oil or gas well, the method comprising including in the wireline tool string a roller device, the roller device having a body, and having a plurality of rollers on the outer surface of the body, wherein the rollers comprise captive bearings arranged to rotate around more than one axis relative to the body, and wherein the rollers are helically arranged on the body, and supporting the body in the wellbore by means of the rollers.

Typically the rollers are arranged in at least two helices extending around the body. Typically the rollers are arranged in at least three helices.

Typically the or each helix completes at least one full circumferential turn around the body.

Typically the pitch of the or each helix is between 25 and 45 degrees. In certain examples of the invention, the pitch can be between 30 and 40 degrees, and typically 33-37 degrees. Typically the pitch of each helix is the same, but in certain embodiments this is not necessary.

Typically the rollers circumferentially overlap one another on the body, so that when the body engages the inner wall of the wellbore, the entire circumference of the body is supported by at least one roller, and typically by two or more rollers, for example 3 or 4 rollers, which may be axially spaced from one another, and can optionally be circumferentially spaced from one another (i.e. the rollers supporting the body need not be aligned and can be circumferentially staggered with respect to one another. Typically the overlap between rollers can be even, but examples of the invention can be made with uneven distribution of rollers.

Typically the rollers on one helix overlap with rollers on another helix. Thus overlapping rollers engaging the wall at the same time can be axially relatively close to one another, and are adapted to land close together in the same area of wall, which helps in grounding the device and avoiding engagement of a blank part of the body on an uneven part of the wall.

Typically the rollers are mounted on at least one helical ridge formed on the outer surface of the body. Typically the rollers are spaced along the helical ridge at regular intervals, and optionally each roller on the helical ridge is axially and circumferentially spaced away (e.g. helically spaced) from adjacent rollers on the ridge. Typically at least three separate helical ridges are formed on the outer surface of the body, each ridge having a plurality of helically spaced rollers.

Typically the roller device has at least one helical channel extending along the body. Optionally the helical channel can be formed between adjacent helical ridges. Typically the helical ridges can be substantially parallel to one another, so that channels formed between the ridges have a consistent width along their length.

Typically the channels provide bypass conduits extending along the body, to allow fluid in the wellbore to displace past the body as the tool moves axially through a fluid-filled wellbore. Optionally where more than one channel is provided, the channels can be the same width and can have the same general dimensions, but this is not necessary and where two or more channels are provided on one body, they can be different widths.

Typically the body has a through bore (typically an axial through bore) to allow passage of cables or fluid along the body. Typically the through bore extends through the end connectors, allowing communication with through bores in the string. Some bodies can omit this feature in different examples of the invention.

Optionally at least one end of the body has a tapered nose or tail.

Typically the body has an end connector at each end, although it is feasible to provide a connector at one end only.

Optionally the walls of the channels extend radially from the body. Optionally the walls of the channels can be parallel to one another and perpendicular to the axis of the body, but it is advantageous in some examples to have the walls of the channel diverging from one another as they extend radially away from the body. Hence in some examples of the invention, the walls of the channel diverge from a base to an outer surface, so that the width of the channels at the outer surface is larger than the width of the channels at the base of the walls.

Typically each roller comprises a roller assembly in the form of a ball held captive in a socket but free to rotate within the socket. Typically the sockets are recessed into the outer surface of the body. Typically the sockets are recessed into the ridge, typically on the radially outermost face of the ridge. Typically the sockets allow the ball to protrude from the outer surface of the body, e.g. from the outer face of the ridges, so that the balls engage the inner surface of the wall of the wellbore when the roller device is moving, and so that the balls rotate freely within the sockets to reduce the friction between the body and the wellbore during movement of the roller device within the wellbore.

Optionally the sockets are provided in a radially outer face of the ridge, spaced along the ridge. Optionally the sockets are housed in recesses on the ridge. Typically the recesses on the ridge have at least one access port allowing access to the recess from the outer face of the ridge.

Typically the sockets can have an annular groove on their inner faces, which can be aligned with a matching groove in the roller assembly, and a retaining member such as a spring wire or a circlip can be retained in the grooves to extend between the break line of the matching grooves and retain the roller assembly in the socket. The groove can have arcuate walls or flat walls, to match the retaining member. Instead of a groove, the roller assembly can optionally have a shoulder, typically an upward facing shoulder. The circlip can optionally have flat faces in certain examples, to press radially against flat faces oriented in a radial direction with respect to the axis of the body, in order to better retain the roller assembly radially within the socket.

The retaining member is typically resilient and is energised by insertion into the groove, so that it expands within the groove as a function of its resilience and resists removal from the groove by movement of the roller within the socket.

Optionally the retaining member can comprise a split ring, with a joint adapted to expand and contract circumferentially within the groove, and is typically biased to expand in the groove. Optionally the retaining member can be a simple sprung wire.

Optionally each socket has an access port connecting the outer face of the recess and the groove, to enable intervention to free the retaining member from the groove. Optionally more than one access port can be provided for each socket. Optionally the access port can be an access channel formed in the outer face of the ridge, connecting the sockets. Typically the access port intersects with the grooves receiving the retaining member.

Optionally the ball can be non-metallic. Optionally the ball can comprise a non-galling material. Optionally the ball can comprise a hardened material. Optionally the ball can comprise a corrosion resistant material. Optionally the ball can comprise a ceramic material such as silicon nitride.

Optionally the ball can be supported in the roller assembly on a race of bearings, which can be formed from similar materials to the ball. The race of bearings can typically be of smaller diameter than the ball, and can be retained in a cup forming part of the roller assembly. The cup can be fitted with a cap, which can typically have a port for the ball to protrude from the roller assembly, and optionally a seal to seal the ball to the roller assembly, typically sealing off the port from the race and cup.

Optionally the body of the roller assembly can be formed from a ferrous metal, and so can be attracted by a magnet to assist removal of the roller assembly from the socket. A martensitic stainless steel is a suitable material for the body of the cup and optionally for the cap.

Typically the balls can protrude from the outer surface of the body by a small amount, e.g. 2-10 mm.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one example can typically be combined alone or together with other features in different examples of the invention.

Various examples and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having" "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa. References to positional descriptions such as upper and lower and directions such as "up", "down" etc. in relation to the well are to be interpreted by a skilled reader in the context of the examples described and are not to be interpreted as limiting the invention to the literal interpretation of the term, but instead should be as understood by the skilled addressee, particularly noting that "up" with reference to a well refers to a direction towards the surface, and "down" refers to a direction deeper into the well, and includes the typical situation where a rig is above a wellhead, and the well extends down from the wellhead into the formation, but also horizontal wells where the formation may not necessarily be below the wellhead.

BRIEF DESCRIPTION OF THE DRAWINGS

In the accompanying drawings.

DESCRIPTION OF THE PREFERRED EMBODIMENTS

Figure 3:
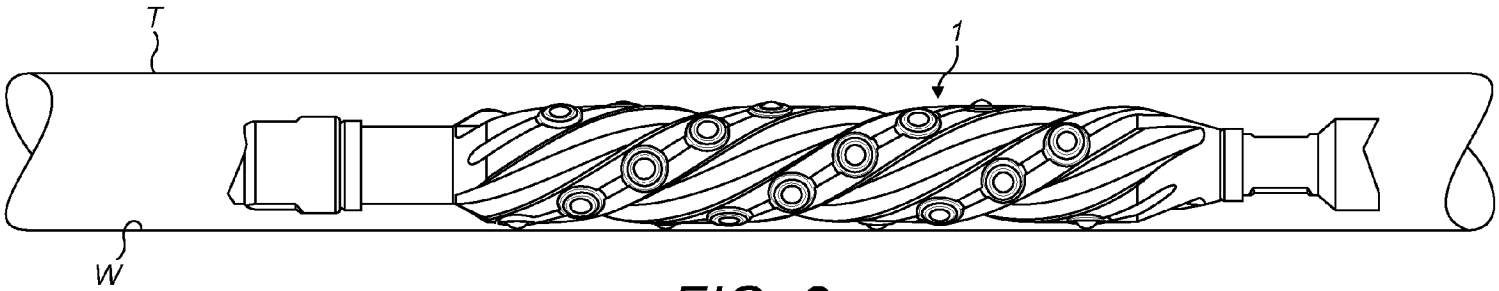
FIG. 3 is a side view of the roller device included in the tool string, within a section of tubing in a wellbore.

Referring now to the drawings, an example of a roller device 1 is typically used to facilitate the movement of a wireline or slick line tool string along a deviated well to a target location within the well. Typically the well is cased or lined with casing or the like, but in this example, the tool string 2 is being run within a tubing string of production tubing T with an internal wall W as shown in FIG. 3. Typically the tool string 2 includes at least one roller device 1, but optionally three or more roller devices 1 can be run on the tool string 2, typically one just below the uppermost section of stem weight, and one on either side of the mechanical jars (most wireline and slickline tool strings include a set of mechanical jars to manipulate and retrieve stuck equipment, which jar the string in the event of the string becoming stuck on the inner surface of the wellbore).

Figure 1:
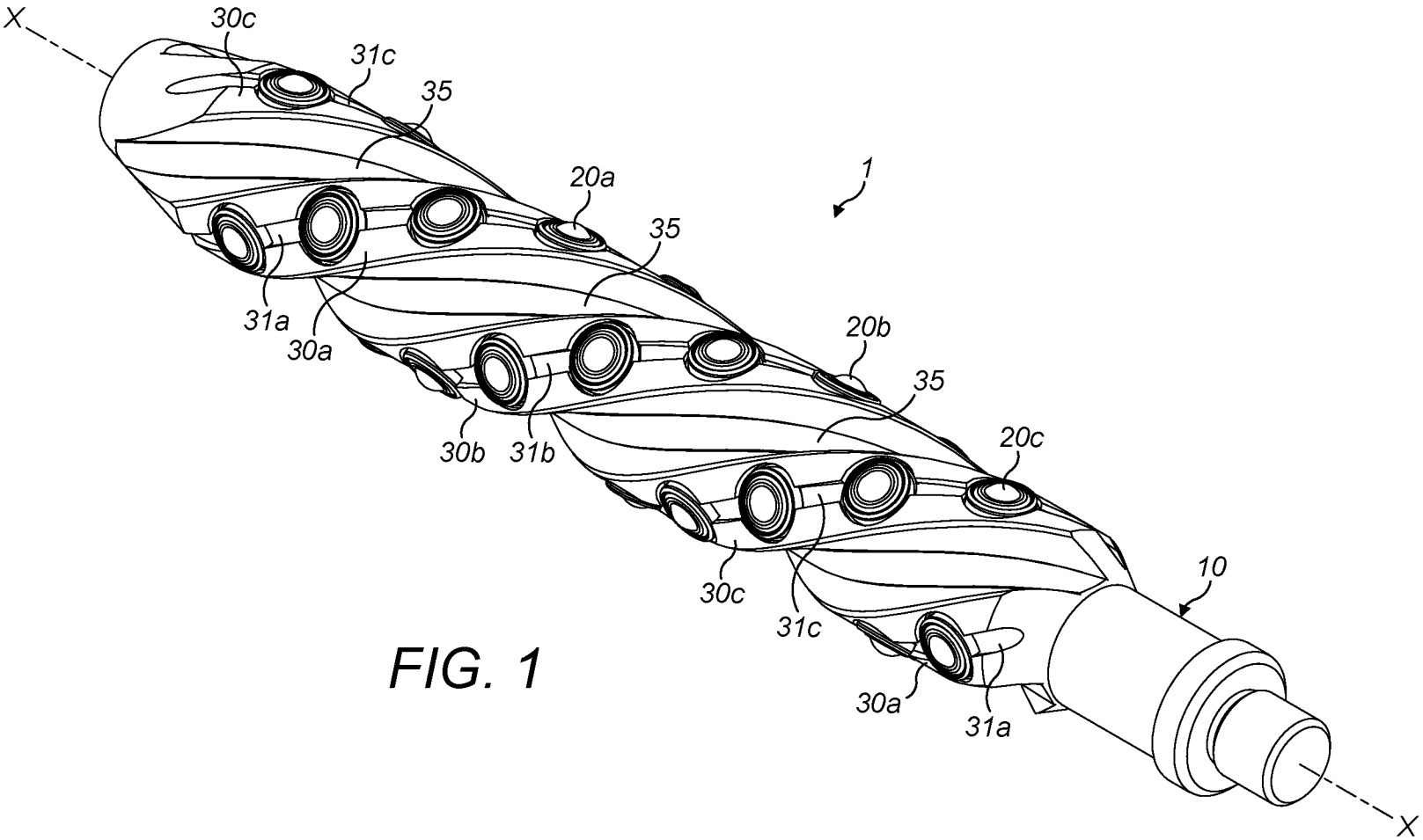
FIG. 1 is a perspective view of a roller device according to a first example.
Figure 2:
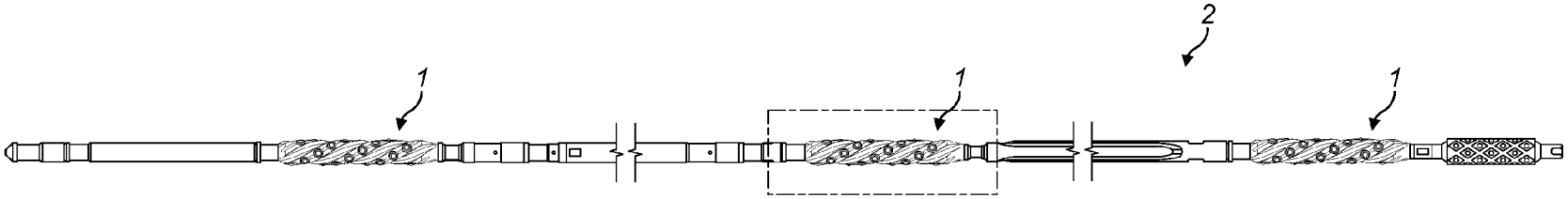
FIG. 2 is a side view of a tool string incorporating the FIG. 1 roller device.
Figure 17:
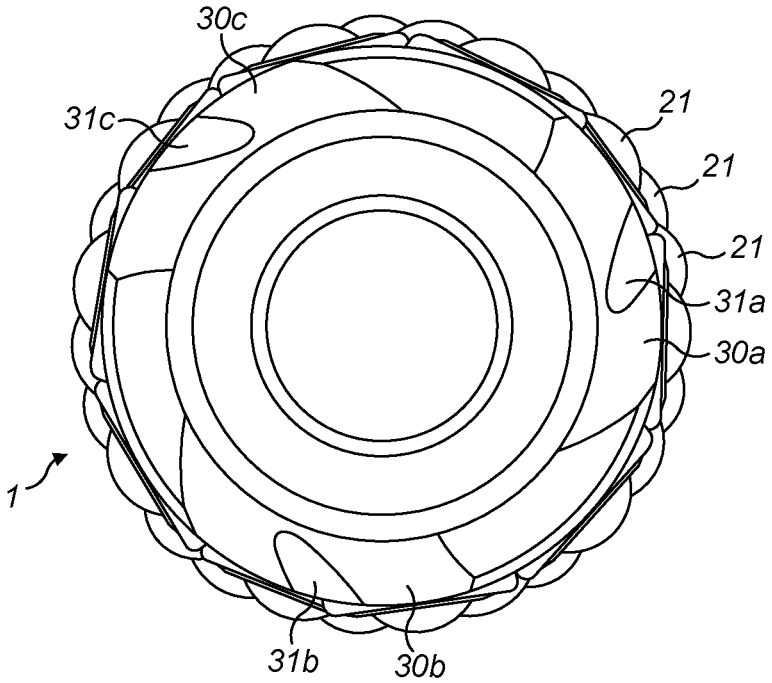
FIG. 17 is an end view of the FIG. 1 roller device.

Referring now to FIG. 1, a roller device 1 comprises a body 10, and a plurality of rollers in the form of roller assemblies 20, which are arranged helically on the body 10. In the present example, there are three helical arrangements of roller assemblies 20 which are typically arranged on helical ridges 30*a*, 30*b* and 30*c*, which are typically substantially identical to one another, at a pitch of around 33 degrees with respect to the axis of the body, and are arranged substantially parallel to one another, but staggered with respect to one another around the circumference, so that the start of each helical ridge 30 is spaced around the circumference of the body 10, as best shown in FIG. 17. Other sizes can typically have different pitches, for example, a version of the device for operation in a 2 inch hole, can have a pitch angle of 26.37 degrees, whereas a version suited for operation in a 4 inch hole can have a pitch angle of slightly less than 40 degrees. Typically each ridge 30 completes at least one complete circumferential turn around the body 10. Each helical ridge 30 typically has a radially outer face and sidewalls, which typically converge as each helical ridge 30 extends radially from its base towards the outer surface. The outer surface of each helical ridge 30 is typically flat, and typically has an access port in the form of a channel 31, which in each case in this example follows the helical ridge 30 along the outer surface. Typically the channels 31 can be milled in the body.

The ends of the body 10 (at least the leading end) can optionally have a tapered section narrowing to a reduced diameter as it approaches the end of the body 10, in order to present a lower impedance to the passage of the body 10 through fluid. Typically the nose angle of the leading end is around 15 degrees.

Figure 13:
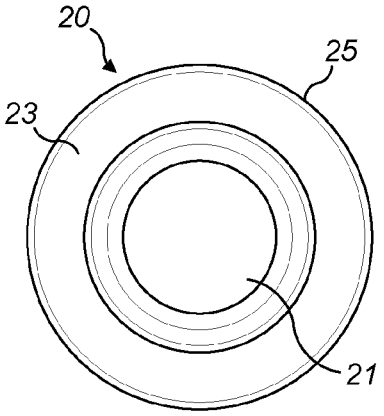
FIGS. 13-15 show plan, side and perspective views of a roller.
Figure 14:
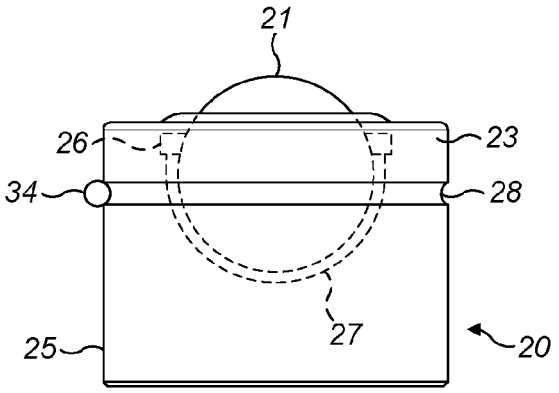
Figure 15:
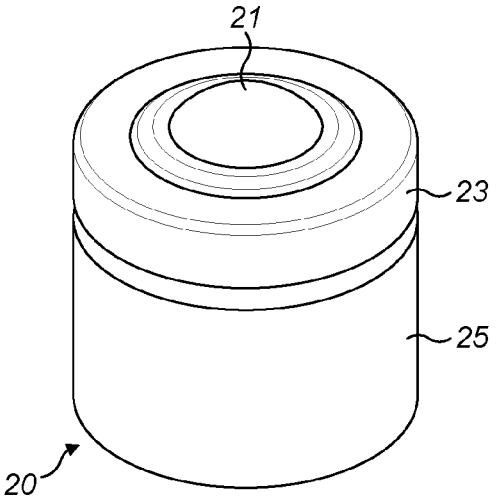
Figure 16:
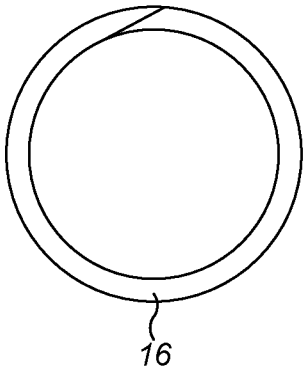
FIG. 16 shows a plan view of a seal used in the roller of FIGS. 13-15.

The roller assemblies 20 are shown in FIGS. 13-15. Each roller assembly typically has a ball 21 with a relatively small diameter, contained in a housing 25 and retained therein by a cap 23, having a central aperture through the cap 23 to allow the ball 21 to protrude from the outer surface of the roller assembly 20. The ball 21 is supported in the housing 25 by a socket or cup 27 typically having a bearing race lined with smaller ball bearings (not shown) which are disposed between the ball 21 and the cup to allow the ball 21 to rotate freely in any direction within the cup, but the cap 23 retains the ball 21 within the housing and although it can freely rotate it cannot move radially or laterally with respect to the roller assembly 20. The body of the roller assembly 20, the bearings and the cup can typically comprise a steel, typically stainless steel. The ball 21 can rotate in any direction as a result of the bearings and cup supporting it. Optionally the ball can be sealed in the housing 25 by a resilient seal 26 which can have an arcuate radially inner face that is shaped to match the radius of the ball 21, so that any fluid to which the aperture is exposed does not enter the race 27 behind the seal. The seal 26 can be annular, or can have an expandable scarf joint. The seal can comprise glass filled PTFE, rubber, or another resilient sealing material.

The roller assembly can optionally have an annular groove 28 on its outer surface between the cap 23 and the housing 25 and/or a ledge or shoulder, typically facing upwards towards the cap.

Typically the ball 21 is formed from a hardened non-metallic material. In this example, the ball is formed of silicon nitride, which does not gall under high forces, and is relatively resistant to downhole corrosive fluids. The smaller bearings in the race 27 can optionally be formed from similar materials, or can be simple steel. Typically the housing 25 can be formed from a ferrous metal, and so can be attracted by a magnet to assist removal of the roller assembly 20 from the recess 32.

Each roller assembly 20 is typically retained in a recess 32. Each recess 32 is typically a blind ended recess formed centrally on the ridges 30. The recesses 32 are typically spaced along the ridges 30 at regular intervals, and typically follow the helical path of the ridges 30. Hence the recesses 30 are spaced apart along the helical path defined by the ridges on the body. Each of the recesses 32 is typically deep enough to receive the roller assembly 20 in a neat fit with a small clearance, and typically has an annular groove 38 to match the groove 28 on the roller assembly 20. In certain embodiments, an upwardly facing shoulder on the roller assembly can perform the same function as the groove 28.

Figure 19:
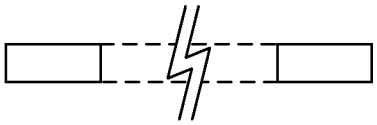
FIG. 19 shows a schematic side sectional view of a second example of a retaining member (not to scale)
Figure 20A:
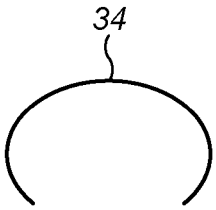
FIGS. 20(*a*) and (*b*) shows a schematic plan view of the retaining member of FIGS. 18 and 19 in an expanded configuration (shown in FIG. 20(*a*) and a compressed configuration (shown in FIG. 20(*b*); and, FIG. 21 shows a side view of an alternative roller to that shown in FIGS. 13-15.
Figure 20B:
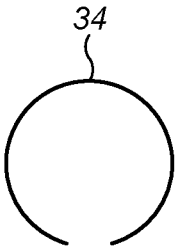
Figure 21:
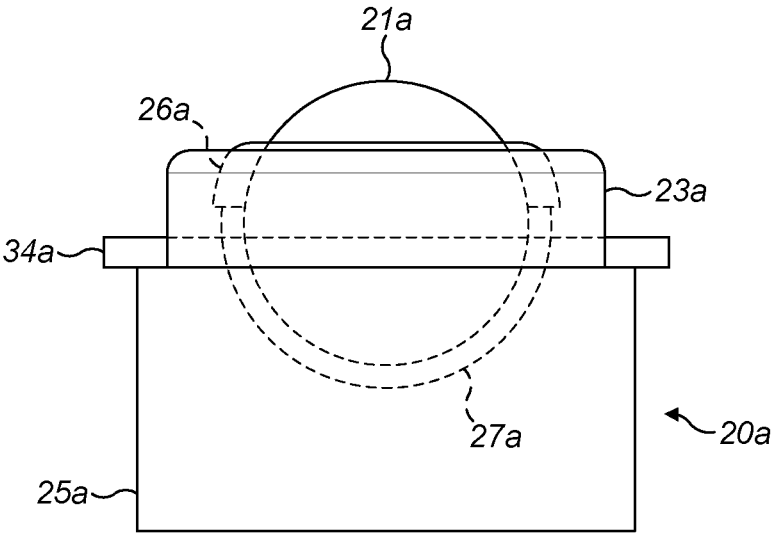

The grooves 28, 38 (or the groove 38 and a shoulder) combine to receive and compress a retaining member 34 which spans across the break line between the grooves 28, 38 and retains each roller assembly 20 in its recess 32. The retaining member 34 can optionally be a simple wire or band of resilient material and is typically spring steel or Inconel, and is compressed in the grooves and so therefore is energised to expand radially and resist movement of the retaining member out of the aligned grooves 28, 38 when the roller assembly 20 is in the recess 32. The typical (schematic) uncompressed and compressed forms of the retaining member 34 are shown in FIG. 20. The retaining member can also comprise a circlip or the like, and typically has flat upper and lower faces as shown in FIG. 19, which typically match flat upper and lower faces of the grooves to retain the roller assembly 20 in the recesses 32 against pull out forces. Optionally the retaining member 34 can comprise a split ring, adapted to expand and contract circumferentially within the groove, and is typically biased to expand into the groove to retain it therein. The retaining member typically has a larger radial dimension than the groove, so protrudes from it when it is compressed.

Each recess 32 provides a socket for a respective roller assembly 20. The recesses 32 are typically connected by the channel 31 which is typically continuous and is formed in the outer face of the ridges 30, connecting the outer face of each recess 32 and its groove, to enable intervention to free the retaining member 34 from the groove. The access channel 31 typically intersects with the groove on at least the recess 32 in the body, so that the groove on the body can be accessed from the channel 31, in order to manipulate (i.e. remove, install and adjust) the retaining member 34 keeping the roller assembly in place. This allows access to the retaining member from outside the tool, without removing screw, bolts etc.

Figure 4:
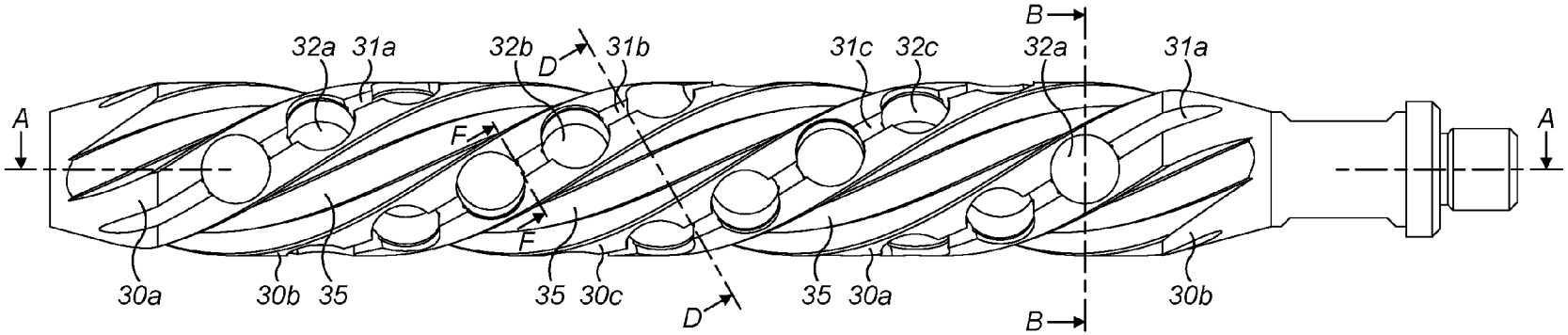
FIG. 4 is a side view of a body of the FIG. 1 roller device.
Figure 5:
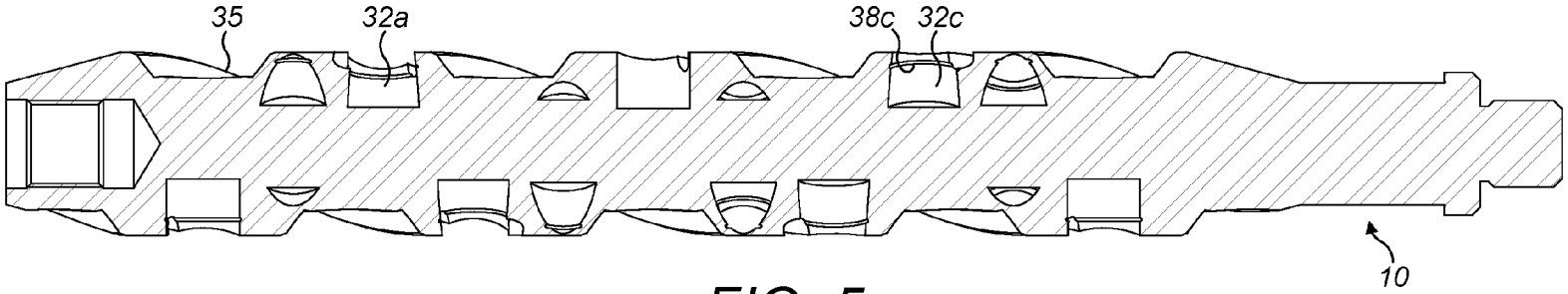
FIG. 5 is part section view through the FIG. 4 body through A-A.
Figure 6:
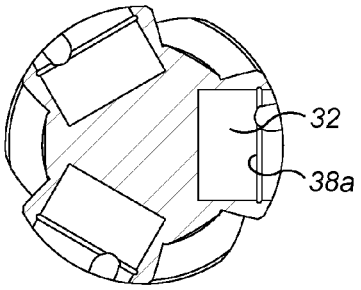
FIG. 6 is a section view through the FIG. 4 body through B-B.
Figure 7:
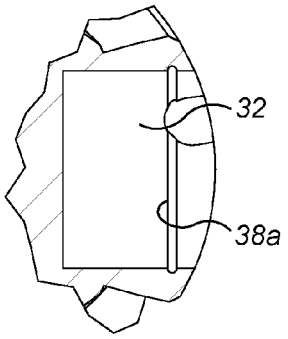
FIG. 7 is an enlarged view of a portion of FIG. 6.
Figure 8:
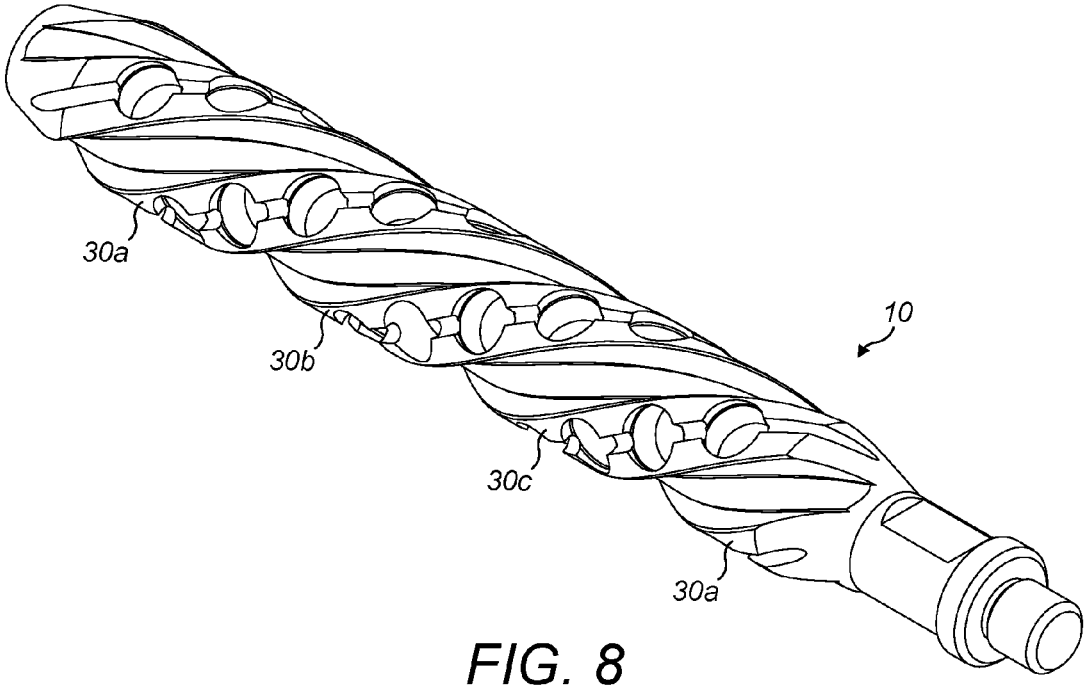
FIG. 8 is a perspective view of the FIG. 4 body.
Figure 9:
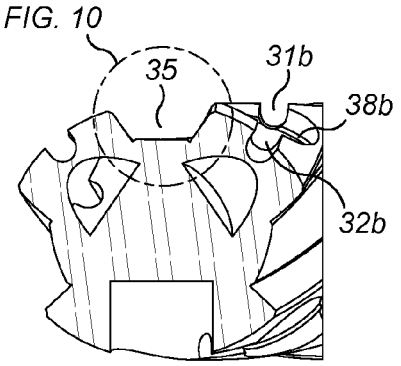
FIG. 9 is a sectional view through D-D of FIG. 4, in a section perpendicular to a helical groove in the FIG. 4 body.
Figure 10:
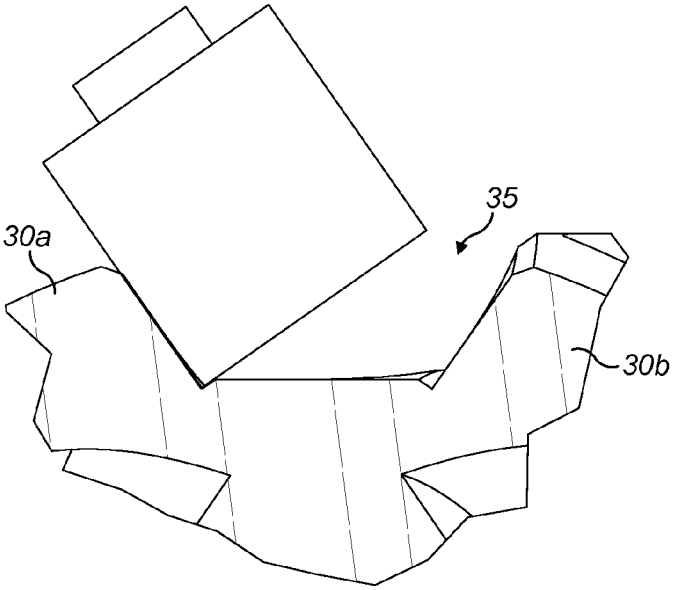
FIG. 10 is an enlarged view of a portion of FIG. 9.
Figure 11:
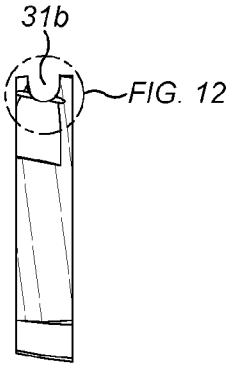
FIG. 11 is a sectional view through F-F of FIG. 4.
Figure 12:
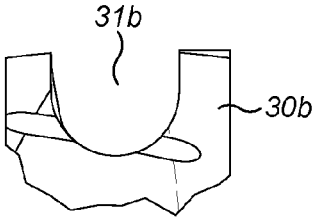
FIG. 12 is an enlarged view of a portion of FIG. 11.
Figure 18:
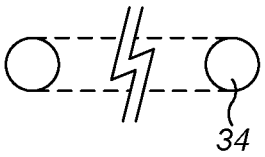
FIG. 18 shows a schematic side sectional view of a retaining member used in the roller of FIGS. 13-15 (not to scale)

In the current example, as best shown in FIG. 18, the roller assemblies 20 overlap one another on the circumference on the body 10, so that when the body 10 engages the inner wall W of the wellbore, as shown in FIG. 3, the entire circumference of the body 10 is supported by at least three (or more) roller assemblies 20, which are axially spaced from one another. In the embodiment shown in FIG. 3, the supporting assemblies engaging the wall W are circumferentially aligned and so contact the wellbore wall W at exactly the same circumferential point on the body 10 of the device 1, but in certain examples, the supporting roller devices 20 can optionally be circumferentially spaced from one another (i.e. the roller assemblies supporting the body 10 need not be aligned and can be circumferentially staggered with respect to one another). The body 10 will also be supported by overlapping roller assemblies 20 that are circumferentially spaced on either side of the supporting rollers, so that the roller device 1 is stably supported on the overlapping rollers. This is best seen in FIG. 4, which shows the recesses 32*a* on the ridge 30*a* which are perfectly aligned with the dotted line representing the axis X-X (at either end of the body 10), and also the recesses on the other ridges 30*b, c*, which are staggered on either side of the dotted line. Hence if the body were to land on the section of the circumference aligned with the dotted line in FIG. 4, it would be supported by the roller assemblies 20 in the recesses 32*a*, which are perfectly aligned with that section of the circumference, and also by the roller assemblies on either side of the dotted line, which would stabilise the body against rocking movement in the well, leaving more kinetic energy to assist in axial penetration of the string through the wellbore, and would also ensure that even the side stabilising devices on either side of the dotted line were still allowing free rotation of the balls 21 in any direction and therefore would be presenting the least possible impedance to the axial movement of the string 2.

Typically the roller assemblies 20*a* on the ridge 30*a* overlap circumferentially with roller assemblies 20*b* and 20*c* on the other helical ridges 30*b*, and 30*c*. See for example, FIG. 1, wherein the first roller assembly 20*a* overlaps circumferentially with the roller assemblies 20*b* and 20*c*. Thus overlapping roller assemblies engaging the wall at the same time can be axially relatively close to one another, and are adapted to land close together in the same area of wall, which is more likely to be level and consistent than patches of wall W that are axially further apart from one another. This helps in grounding the roller device 1 stably on the wall W and helps to ensure that the wall W is generally only engaged by the roller assemblies and not by a part of the body without a supporting roller assembly 20.

At least one bypass channel 35 extends helically along the body between adjacent helical ridges 30. Typically the helical ridges 30 are substantially parallel, so that channels 35 formed between the ridges 30 have a consistent width along their length. The channels provide bypass conduits extending along the body, to allow fluid in the wellbore to flow past the body as the tool moves axially through a fluid-filled wellbore, so as to reduce impedance to axial movement of the string 2 through the wellbore. The walls of the channels 35 extend radially from the body 10, diverging from the body 10 as they extend radially away from the body, so that the width of the channels at the outer surface is larger than the width of the channels at the base of the walls, to provide a large area of flowpath for the fluid to bypass the body 10, which reduces the impedance further.

In operation, the string 2 is assembled from the usual tools and at least one (but typically more than one) roller device 1 is incorporated into the string 2 by means of the end connection provided at least at one end of the roller device 1. Before connection into the string, the recesses 32 are loaded with roller assemblies 20 which are secured therein by retaining members 34, which can be inserted through the access channel 31 in each helical ridge 30. Once the retaining members 34 are expanded in place across the break lines of the grooves, and the roller assemblies 20 are thereby retained in the recesses 32, the tool string 2 is lowered into the wellbore. In deviated sections of the wellbore the tool string 2 will rest on the lower wall W as shown in FIG. 3. Because of the helical arrangement of the roller devices allowing the circumferential overlap between the roller assemblies, the body 10 of the roller device 1 will never touch the wall W, as it will always be supported by at least one (and typically more than one) roller assembly 20. Typically each circumferential position on the body will be supported by more than one ball 21 on circumferentially adjacent roller assemblies 20. Since the roller assemblies 20 allow free rotation of the balls 21, the device 1 is typically always able to move in any direction along the wall W of the tubular with the minimum of impedance to movement, and hence the reach of the tool string 2 employing the roller device of the invention is improved, even in highly deviated wells. Also, because the roller assembly 20 allows the ball 21 to rotate freely in any direction in the housing 25, the configuration of the rollers allows free rotation of the roller device 1 around its axis X-X. This reduces the extent to which the rollers will drag across the surface of the wall W, and provides less impedance to movement of the string 2 in the wellbore.

The roller assemblies 20 can optionally be removed from a body 10 for service or replacement by disrupting the retaining member 34 from the break line between the grooves 28, 38. The retaining member 34 can be accessed through the channel 31. In the event that the roller assemblies 20 become stuck in the recesses 32, the magnetic housing 25 can be attracted by a magnet to assist with removal.

Modifications and improvements can be incorporated without departing from the scope of the invention. In certain embodiments, only one end connection is needed, as the roller device could be destined for an end terminus of the string 2. Different end connectors can be provided within the scope of the invention. Examples of commonly used connections are QRJ, HDQRJ, QLS, BR and SR joints, known to the skilled person.

In a further modification, a modified roller assembly 20*a* is shown in FIG. 20, which is similar to the roller assembly 20 and like parts (ball 21*a*, seal 26*a*, housing 25*a*, cap 23*a*, socket 27*a*) have similar characteristics to the corresponding parts of the assembly 20 as described above; hence the reader is referred to the previous description for more detail of these features in relation to this example. The roller assembly 20*a* differs from the roller assembly 20 in that instead of being retained in the recess by a pair of matching grooves receiving the retaining member, each roller assembly 20*a* receives and retains the retaining member in aligned formations in the form of annular shoulders. In this example, the roller assembly 20*a* has an upwardly facing annular shoulder 28*a* on its outer surface typically between the cap 23*a* and the housing 25*a*. The shoulder 28*a* cooperates with an annular groove or with a downwardly facing shoulder on the recess in the body to receive and typically to compress a retaining member 34*a* in the form of a split ring or circlip or the like, similar to the retaining member 34, which spans across the break line between the shoulders 28*a*, 38*a* and retains each roller assembly 20*a* radially within its recess 32. Otherwise the function of the roller assembly 20*a* is similar to that described above for the roller assembly 20.

The roller devices 20 could be held in the recesses 32 by screw attachments, for example a threaded socket in the recess and a corresponding thread on the housing or on a shaft attached to the housing, and could optionally have splines or other driving formations enabling torque to be applied to the roller devices to install or remove them from the recess.

The invention claimed is:

1. A wireline roller device for incorporation into a wireline tool string for use in an oil or gas well, the roller device having a body with an axis, and at least one connector suitable for connection of the roller device body into the string, and having a plurality of rollers on the outer surface of the body and spaced apart along the axis of the body, wherein the axially spaced rollers comprise captive bearings arranged to rotate around more than one axis relative to the body, and wherein the plurality of axially spaced rollers are arranged in at least one helix extending around the body completing at least one full circumferential turn; and wherein two or more axially spaced rollers on the body circumferentially overlap one another along a line parallel to the axis of the body.

2. A wireline roller device as claimed in claim 1, wherein the rollers are arranged in at least two helices, each helix starting at a circumferentially spaced position on the body, and each helix extending around the body.

3. A wireline roller device as claimed in claim 1, wherein the pitch of the at least one helix ranges from 30 and 40 degrees with respect to an axis of the body.

4. A wireline roller device as claimed in claim 1, wherein when the body engages an inner wall of a wellbore in the well, substantially the whole circumference of the body is supported by at least two or more rollers, which are axially spaced from one another.

5. A wireline roller device as claimed in claim 4, wherein the two or more rollers supporting the body and spacing the body from the inner wall of the wellbore are circumferentially offset from one another.

6. A wireline roller device as claimed in claim 4, wherein the rollers are arranged in at least two helices, each helix starting at a circumferentially spaced position on the body and each helix extending around the body, and wherein rollers on one helix overlap circumferentially with rollers on another helix.

7. A wireline roller device as claimed in claim 1, wherein the plurality of rollers are mounted on at least one helical ridge extending from the body in a radial direction with respect to the axis of the body.

8. A wireline roller device as claimed in claim 7, wherein the rollers are spaced along the helical ridge.

9. A wireline roller device as claimed in claim 7, wherein each roller on the helical ridge is axially and circumferentially spaced away from adjacent rollers on the ridge.

10. A wireline roller device as claimed in claim 7, having at least three separate helical ridges on the outer surface of the body, each ridge having a plurality of helically spaced rollers.

11. A wireline roller device as claimed in claim 10, wherein the helical ridges are substantially parallel to one another.

12. A wireline roller device as claimed in claim 7, wherein the roller device has at least one helical channel extending along the body between adjacent helical ridges.

13. A wireline roller device as claimed in claim 12, wherein the walls of the channels diverge from one another as they extend radially away from the body.

14. A wireline roller device as claimed in claim 1, wherein at least one end of the body is tapered.

15. A wireline roller device as claimed in claim 1, wherein each roller comprises a roller assembly in the form of a ball held captive in a socket but free to rotate within the socket.

16. A wireline roller device as claimed in claim 15, wherein the socket is recessed into the outer surface of the body.

17. A wireline roller device as claimed in claim 16, wherein the plurality of rollers are mounted on at least one helical ridge extending from the body in a radial direction with respect to the axis of the body, and wherein the sockets are recessed into the ridge.

18. A wireline roller device as claimed in claim 15, wherein the socket allows the ball to protrude from the outer surface of the body so that the ball engages the inner surface of a wall of the wellbore when the roller device is moving, and so that the balls rotate freely within the sockets to reduce the friction between the body and the wellbore during movement of the roller device within the wellbore.

19. A wireline roller device as claimed in claim 15, wherein the socket has an annular formation on the socket's inner face, which aligns with a matching annular formation in the roller assembly when the roller assembly is received in the socket, and wherein the aligned annular formations on the socket and roller assembly retain a retaining member extending across a break line of the aligned formations thereby resisting movement of the roller assembly out of the socket when the retaining member is in place in the aligned formations.

20. A wireline roller device as claimed in claim 19, wherein the retaining member is resilient and is energised by insertion into the aligned formations, so that it expands within the aligned formations as a function of its resilience and resists removal from the aligned formations.

21. A wireline roller device as claimed in claim 19, wherein the retaining member comprises a split ring, with a joint adapted to expand and contract circumferentially within the aligned formations, and wherein the retaining member is biased to expand in the groove.

22. A wireline roller device as claimed in claim 19, wherein each socket has at least one access port connecting an outer face of the recess with at least one of the aligned formations, to enable intervention to free the retaining member from the formation.

23. A wireline roller device as claimed in claim 22, wherein the access port comprises an access channel formed in the outer face of the ridge.

24. A wireline roller device as claimed in claim 23, wherein the channel connects adjacent sockets.

25. A wireline roller device as claimed claim 22, wherein the access port intersects with at least one of the aligned formations.

26. A wireline roller device as claimed in claim 15, wherein the ball is non-metallic.

27. A wireline roller device as claimed in claim 15, wherein the ball comprises a non-galling material.

28. A wireline roller device as claimed in claim 15, wherein the ball comprises a ceramic material.

29. A wireline roller device as claimed in claim 15, wherein the ball is supported in the roller assembly on a bearing race, having a smaller diameter than the ball.

30. A wireline roller device as claimed in claim 29, wherein the race of bearings is retained in a cup forming part of the roller assembly, and wherein the roller assembly comprises a cap covering the cup, wherein the cap has an aperture for the ball to protrude from the roller assembly, and a seal to seal the ball to the roller assembly, sealing off the port from the race and the cup.

31. A wireline roller device as claimed in claim 1, wherein the roller assembly comprises a ferrous metal, and so can be attracted by a magnet to assist removal of the roller assembly from the socket.

32. A wireline roller device as claimed in claim 1, where the roller is free to rotate in any direction with respect to the body, but is fixed against lateral and radial movement of the roller relative to the body.

33. A method of deploying a wireline tool string in a wellbore of an oil or gas well, the method comprising including in the wireline tool string a wireline roller device, the wireline roller device having a body with an axis, and having a plurality of rollers on the outer surface of the body and spaced apart along the axis of the body, wherein the axially spaced rollers comprise captive bearings arranged to rotate around more than one axis relative to the body, and wherein the rollers are helically arranged such that the helix completes at least one full circumferential turn on the body, and supporting the body in the wellbore by at least two axially spaced rollers on the body which circumferentially overlap one another along a line parallel to the axis of the body.

34. A roller device for incorporation into a wireline tool string for use in an oil or gas well, the roller device having a body with at least one connector suitable for connection of the roller device body into the string, and having a plurality of rollers on the outer surface of the body, wherein the rollers comprise captive bearings arranged to rotate around more than one axis relative to the body, and wherein the plurality of rollers are arranged in at least one helix extending around the body;

wherein each roller comprises a roller assembly in the form of a ball held captive in a socket but free to rotate within the socket;

wherein the socket has an annular formation on the socket's inner face, which aligns with a matching annular formation in the roller assembly when the roller assembly is received in the socket, and wherein the aligned annular formations on the socket and roller assembly retain a retaining member extending across a break line of the aligned formations thereby resisting movement of the roller assembly out of the socket when the retaining member is in place in the aligned formations;

wherein each socket has at least one access port connecting an outer face of the recess with at least one of the aligned formations, to enable intervention to free the retaining member from the formation;

wherein the access port comprises an access channel formed in the outer face of the ridge; and wherein the channel connects adjacent sockets.

* * * * *